US010563966B2

(12) United States Patent
Haberman

(10) Patent No.: US 10,563,966 B2
(45) Date of Patent: Feb. 18, 2020

(54) VIBRATORY POWDER TRICKLER

(71) Applicant: Hornady Manufacturing Company, Grand Island, NE (US)

(72) Inventor: David Haberman, Sheridan, WY (US)

(73) Assignee: Hornady Manufacturing Company, Grand Island, NE (US)

( * ) Notice: Subject to any disclaimer, the term of this patent is extended or adjusted under 35 U.S.C. 154(b) by 0 days.

(21) Appl. No.: 16/189,322

(22) Filed: Nov. 13, 2018

(65) Prior Publication Data

US 2019/0145746 A1 May 16, 2019

Related U.S. Application Data

(60) Provisional application No. 62/585,238, filed on Nov. 13, 2017.

(51) Int. Cl.

| | |
|---|---|
| ***F42B 33/02*** | (2006.01) |
| ***B65B 1/34*** | (2006.01) |
| ***B65B 1/08*** | (2006.01) |
| ***B05B 7/14*** | (2006.01) |

(52) U.S. Cl.

CPC ..... *F42B 33/0207* (2013.01); *B05B 7/1445* (2013.01); *B65B 1/08* (2013.01); *B65B 1/34* (2013.01); *F42B 33/0285* (2013.01); *F42B 33/0292* (2013.01)

(58) Field of Classification Search

CPC ..... F42B 33/0257; F42B 33/0207; F42B 33/0285; F42B 33/0292; B05B 7/1445; B65B 1/08; B65B 1/34

USPC ..... 222/63, 226–248, 358, 362

See application file for complete search history.

(56) References Cited

U.S. PATENT DOCUMENTS

| | | | | |
|---|---|---|---|---|
| 2,376,106 | A | | 5/1945 | Witthofft |
| 2,539,030 | A | | 1/1951 | Parker |
| 2,800,252 | A | | 7/1957 | Wahl |
| 3,091,368 | A | | 5/1963 | Harley et al. |
| 3,266,075 | A | | 8/1966 | Conrad |
| 3,408,774 | A | | 11/1968 | Engel |
| 3,724,819 | A | * | 4/1973 | Varnum ..... B01J 8/002 366/114 |
| 3,765,131 | A | | 10/1973 | Christensen |
| 3,827,513 | A | | 8/1974 | Epstein |
| 4,045,918 | A | | 9/1977 | Freedman |
| 4,171,728 | A | | 10/1979 | Case |
| 4,206,573 | A | | 6/1980 | Hayward |
| 4,277,185 | A | | 7/1981 | Thompson |
| 4,402,426 | A | * | 9/1983 | Faulkner ..... G01G 13/2855 177/113 |
| 4,630,755 | A | * | 12/1986 | Campbell ..... A01C 15/00 177/64 |
| 4,696,356 | A | | 9/1987 | Ellion et al. |
| 4,860,816 | A | * | 8/1989 | Bond ..... B22C 15/10 164/155.3 |
| 4,945,957 | A | | 8/1990 | Kardux et al. |
| 4,987,702 | A | | 1/1991 | Anschutz |
| 5,005,657 | A | | 4/1991 | Ellion et al. |

(Continued)

*Primary Examiner* — Lien M Ngo

(74) *Attorney, Agent, or Firm* — McHale & Slavin, P.A.

(57) ABSTRACT

A powder trickier is provided. The trickier includes a hopper for containing powder in bulk. A dispensing tube has a portion thereof in flow communication with the hopper. A vibrator is associated with the dispensing tube to induce powder flow from the hopper into and through the tube for dispensing powder from a tube outlet.

12 Claims, 4 Drawing Sheets

(56) References Cited

U.S. PATENT DOCUMENTS

| | | | | |
|---|---|---|---|---|
| 5,036,623 | A | 8/1991 | Alonzo et al. | |
| 5,301,844 | A * | 4/1994 | Ricciardi | B65G 65/46 198/550.1 |
| 5,341,307 | A * | 8/1994 | Myhre | G05D 7/0605 177/105 |
| 5,378,499 | A | 1/1995 | Martin et al. | |
| 6,121,556 | A | 9/2000 | Cole | |
| 7,152,761 | B2 * | 12/2006 | Baker | A61F 13/15626 222/161 |
| 9,421,664 | B1 | 8/2016 | Yu | |
| 2008/0041700 | A1 | 2/2008 | Potterfield et al. | |
| 2015/0190549 | A1 * | 7/2015 | Sapoznikov | A61K 35/32 433/215 |

* cited by examiner

VIBRATORY POWDER TRICKLER

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/585,238, entitled "VIBRATORY POWDER TRICKLER", filed Nov. 13, 2017. The contents of the above referenced application is incorporated herein by reference in its entirety.

FIELD OF THE INVENTION

A powder trickler for use in distributing powder (propellant) to a weighing scale.

BACKGROUND OF THE INVENTION

Reloading new and used casings is well known. Reloading typically involves sizing the casing, trimming the sized casing to length, and then cleaning the casing. A primer is then installed in the casing. The reloader will measure a quantity of propellant (commonly called powder or gun powder, and herein referred to as powder) either by weight or volume and deposit it in the casing. A bullet is then seated into the open mouth of the casing.

For higher quality and typically more accurate and precise reloads, the powder is weighed for each charge of powder. Weighing is done in grains of weight, with there being 7000 grains in a pound. Weighing of powder is done with 0.1 grain or finer distinction. Two types of scales are used, a balance beam (mechanical) scale and an electronic scale. Some reloaders use automatic systems like Lock-N-Load® Auto Charge® made by Hornady, and some use manual systems that can take various forms. One manual system requires a large quantity of powder to be first deposited, as with a spoon or other measure, and then a final smaller quantity to be deposited with a manual trickier, for example a Lock-N-Load® Quick Trickle made by Hornady. Both systems are effective; however, the manual powder measuring system is slow and often results in too much powder being deposited, requiring removal of some powder or starting over. Some powders are difficult to remove though. It is more common for a reloader to come up (adding powder) to achieve the correct weight than come down (removing powder) to achieve the correct weight. Thus, the reason for the use of a trickier is the ability to add a single piece of powder at a time. The amount of powder used in a hand loaded shell cartridge can range widely depending on the type of cartridge being produced. Powder weights range from 1.4 grains to 250 grains for a single cartridge. Additionally, the types of powders vary from ball (small spheres), thin circular flakes or wafers to extruded sticks (cylindrical) that are cut to length. Some powders, like the ball type, are difficult to handle and feed.

DESCRIPTION OF THE PRIOR ART

Powder tricklers are well known in the art. A typical trickier has a hopper mounted on a base and a rotatable tube with a feed opening positioned in the hopper. The tube feeds powder from the hopper to a discharge end and then to a weighing scale. Some trickier feed tubes have a screw thread on the inner surface of the feed passage. A user manually rotates the tube to effect powder feeding. One such simple mechanical trickier is the Hornady Powder Trickier. Other brands are available and are of the same general construction and operation. The trickier is typically used to add the last portion of powder in order to finalize the charge of powder at the correct weight, e.g., the last grain or two of powder in small weight increments. Another trickier is the Lock-N-Load® Quick Trickle. It is more complicated in structure, and allows for both a fast feed of powder and a slow feed of powder, as selected by the user. It has a much larger hopper than the simple tricklers. This device is also manually operated. Automatic weigh scales are also available. One such weighing system is the Lock-N-Load® Auto Charge® from Hornady. This system automatically dispenses a preselected weight of powder to the scale and uses a rotating tube that is power driven. This system does not use a manual freestanding trickier.

SUMMARY OF THE INVENTION

It is an objective of the present invention to provide an improved powder trickier to add powder to a scale.

Accordingly, it is a primary objective of the instant invention to provide a trickier that can accommodate both the addition of a large quantity (fast feed) of powder in a short period of time followed by a slow feed of powder simulating the existing manual method.

It is a further objective of the instant invention to provide a trickier that can be used with existing mechanical and electronic scales.

It is yet another objective of the instant invention to provide a trickier that utilizes vibration to effect feeding of powder from a hopper to a weighing scale.

It is a still further objective of the invention to provide a trickier that can provide a variable flow of powder from the hopper to the weighing scale by adjusting the frequency of vibration.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
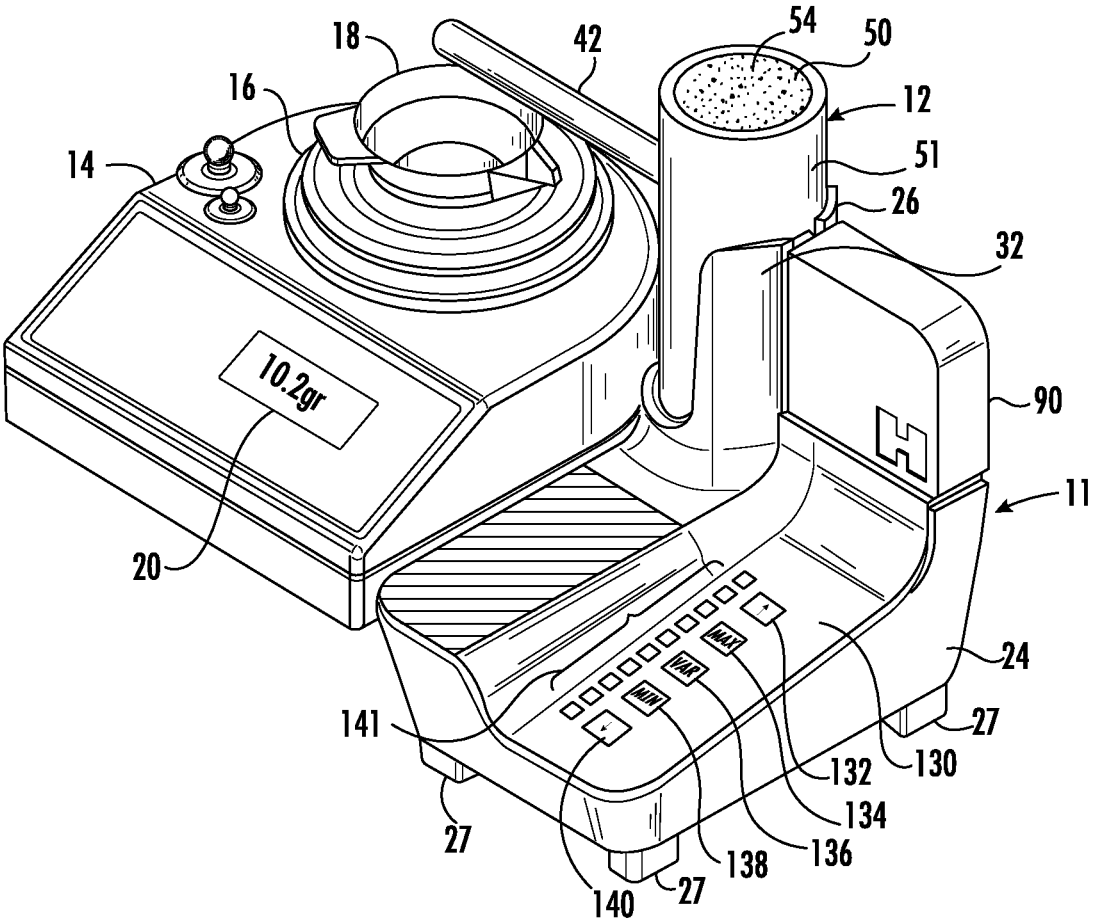
FIG. 1 is a perspective view of a freestanding powder trickier in position to feed powder to a weighing scale.

The reference numeral 11 designates generally a freestanding powder trickler for use in distributing powder from a hopper 12 to a weighing scale 14. The weighing scale 14 can be any suitable scale, such as a mechanical scale or an electronic scale, and has a weighing platform 16 and a cup 18 adapted to rest on the platform 16 and receive powder from the trickier 11. Weighing scales are well known in the art and typically provide a readout in grains and fractions of grains. Sensitivity of such scales is typically on the order of 0.1 grain or finer. The weight of the powder in the cup 18 is displayed on a display screen 20 for electronic scales.

The trickier 11 includes a base housing 24 that is adapted to removably hold the hopper 12 in a retainer 26. The housing 24 can be provided with pads 27 on a bottom surface to resist movement during use of the trickler 11. As shown, the retainer 26 includes a receptacle 28 into which a lower portion of the hopper 12 is received and retained in the receptacle 28 by a sidewall 30. The retainer 26 also includes an upstanding wall 32 extending upwardly from the wall 30 and is configured to abut a sidewall 34 of the hopper 12 to limit movement of the hopper 12 during operation in the use configuration seen in FIG. 1. The wall 32 is provided with an upwardly opening notch 36 that receives therein the powder dispensing tube 42 to help limit movement of the hopper 12 during operation of the trickier 11 and, in particular, to prevent rotation of the hopper 12 during a period of vibration as described below.

The hopper 12 is shown as generally cylindrical, having a storage chamber 50 with an open top 52. It is to be noted that other shapes could be used. The open top 52 is sized and shaped for receiving powder 54 therein for feeding through the tube 42. A partition 58 can be provided to form the upper positioned chamber 50 and separate it from the lower portion of the hopper 12. Preferably, the hopper 12 is made from a tubular member 51 with opposite open ends 52, 60. The hopper 12 can be made from a polymeric or metal alloy material and can be formed by molding. A weight 62 is mounted in the lower portion of the hopper 12 and is secured in place, as for example, with a pin 64 extending through a hole 66 in the sidewall 68 of the hopper 12 and into the weight 62. The weight 62 helps stabilize the hopper 12 during operation, and lowers the center of gravity of the hopper 12. Preferably, a pad 72 is secured to the weight 62 and provides friction for the hopper 12 to help prevent its movement during vibration of the hopper 12 and tube 42. The pad 72 also helps isolate vibrations from being transmitted to an underlying hopper support. The pad 72 can be suitably secured to the weight 62, as by adhesive bonding. A suitable material for making the pad 72 is a silicone elastomer.

The tubular member 51 is provided with a pair of aligned through apertures 76 that are positioned above the partition 58 and receive the tube 42 therethrough. The tube 42 has a powder feed through bore 78 that forms a flow path from the storage chamber 50 to a dispensing flow passage 80 that communicates between the bore 78 and the dispensing end 82 of the tube 42. The passage 80 can be smooth or threaded, but is preferably smooth. In a preferred embodiment, the center of the flow passage 80 is at a height from the bottom of the pad 72 in the range of between about 2 inches and about 4 inches. While the tubular member 51 is shown as having a fixed length, fixing the height of the tube 42 from the bottom of the pad 72, it is to be understood that the tubular member 51 could have an adjustable length as by having one tube slidably received within another tube, forming a telescoping assembly. While the bore 78 is generally oval because it is drilled or otherwise formed through a round tube, other suitable shapes can be provided. Suitable retainers 86, such as O-rings, receive the tube 42 therethrough and retain the tube 42 in position on the tubular member 51 where the bore 78 communicates with the storage chamber 50 for receipt of powder 54 therethrough. The tube 42 is sealed against flow of powder between the end 88 and the bore 78. The pad 72 lies in a plane, providing a flat bottom for the hopper 12 to rest on an underlying surface, and the tube 42 extends generally transversely of the tubular member 51, wherein the longitudinal axis A-A is at an angle relative to the plane of the bottom of the pad 72, preferably in the range of between about +5° (tube sloping uphill to the outlet end 82) and −10° from horizontal (tube sloping downhill to the outlet end 82). The term "about", as used for these values, means within normal manufacturing tolerances and abilities to measure slopes with low precision instruments.

The end portion of the tube 42 adjacent the dispensing end 82 of the tube 42 has a housing 90 secured thereto in any suitable manner, such as by clamping the tube 42 between two housing halves 90A, 90B. The housing halves 90A, 90B are retained together with mechanical fasteners 92, such as screws. The assembled housing 90 has a through opening 96 for receipt of a power cord 98 therethrough. The power cord 98 can have a connector plug 100 that allows the cord 98 to be removably connected to a power source 104 that is preferably housed in the base 24. A suitable power source can be batteries or connection to household current. When batteries are used, a cover 106 can be used to close the compartment containing the batteries 104.

A vibrator assembly 110 is connected to the power cord 98, and is mounted in the housing 90. The vibrator assembly 110 can include an electric motor 112 with an off-balance weight secured to the output shaft thereof, so that when the motor turns, the vibrator assembly vibrates, causing vibration of the housing 90 and the tube 42. In operation, the powder feed bore 78 points generally upwardly, at an angle of 0° plus or minus 45° from vertical. In a preferred embodiment, the frequency of vibration is in the range of between about 50 hertz and about 225 hertz. Also, the amplitude of the vibration of the motor 112, freestanding, is in the range of between about 1 G and about 6 G's. The term "about", as used on these values, means with normal manufacturing tolerances and the ability to measure with low precision instruments. The amplitude is measured according to Precision Microdrives 100 Gram Sled Test, wherein the formula is 1 G=9.8

$$1G = 9.8\ \frac{\mathrm{m}}{\mathrm{s}2}.$$

Figure 2:
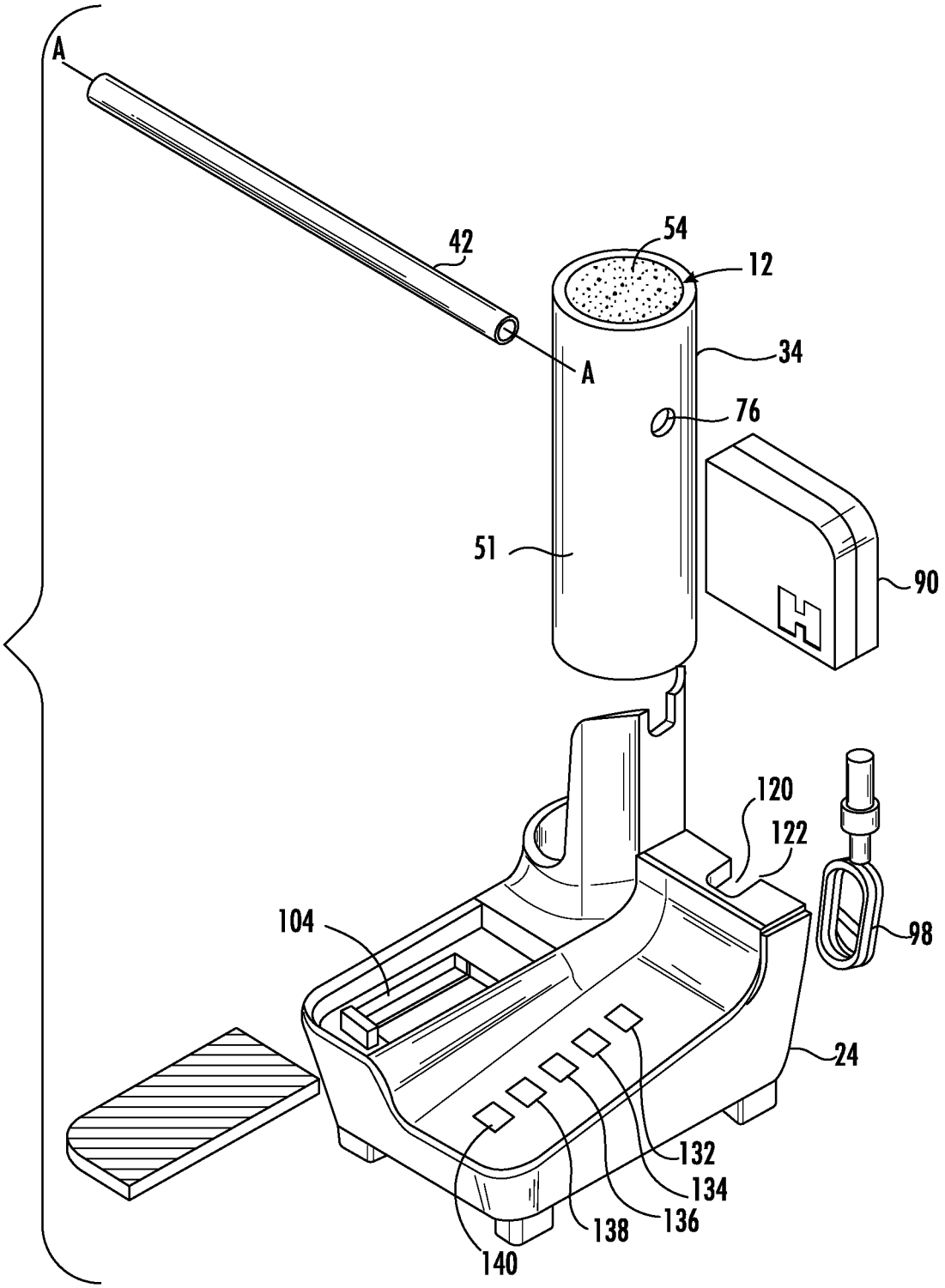
FIG. 2 is an exploded perspective view of the powder trickier of FIG. 1.
Figure 3:
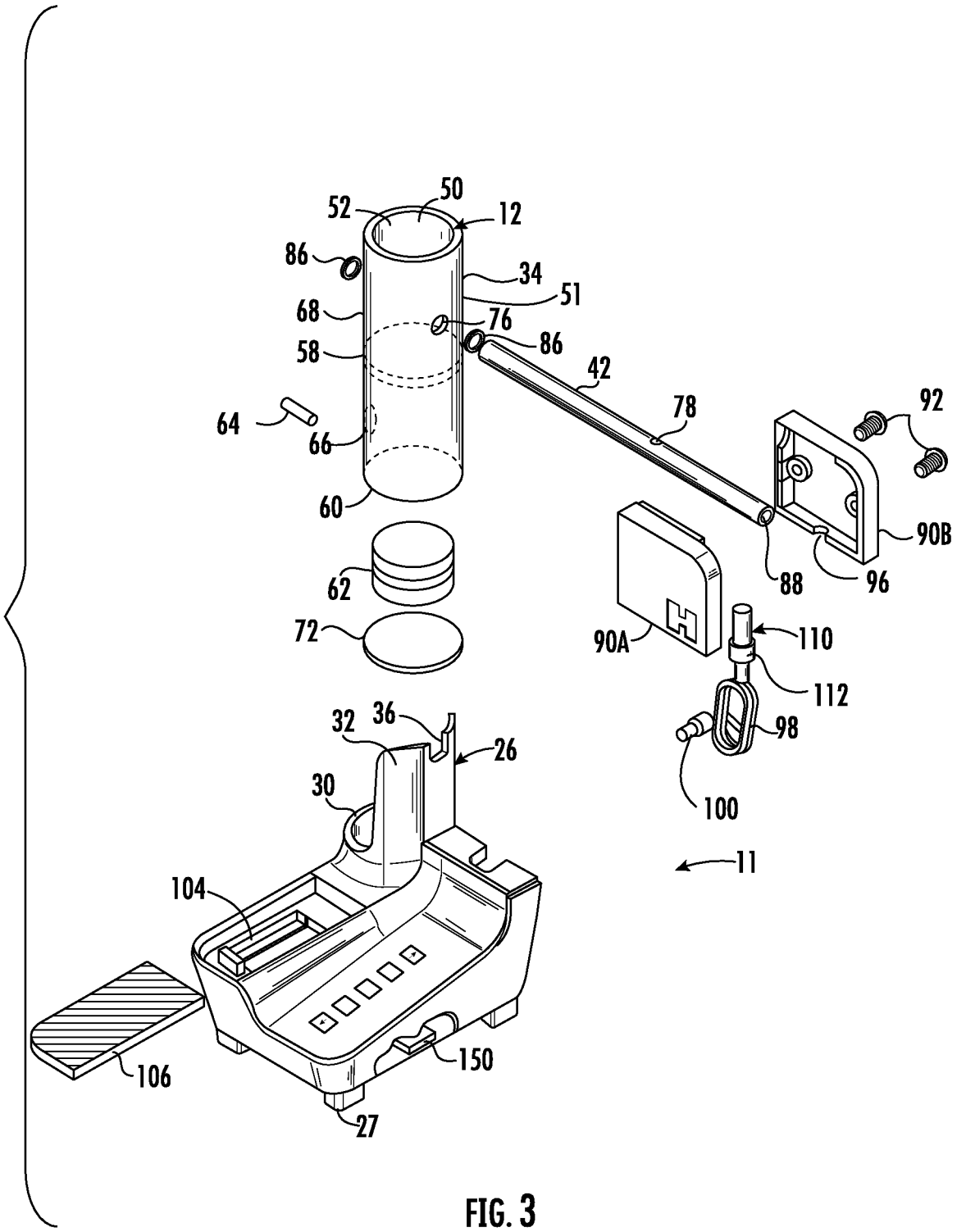
FIG. 3 is an exploded perspective view of the powder trickier of FIG. 2, also showing component parts exploded.

In a preferred embodiment, the axis of rotation of the output shaft (not shown) of the motor 112 is preferably at an angle in the range of between about 75° and about 90° from the longitudinal axis A-A of the tube 42, as seen in FIG. 2. A suitable motor is a Precision Microdrives DC Motor that is variable speed and has the above operating characteristics.

Figure 4:
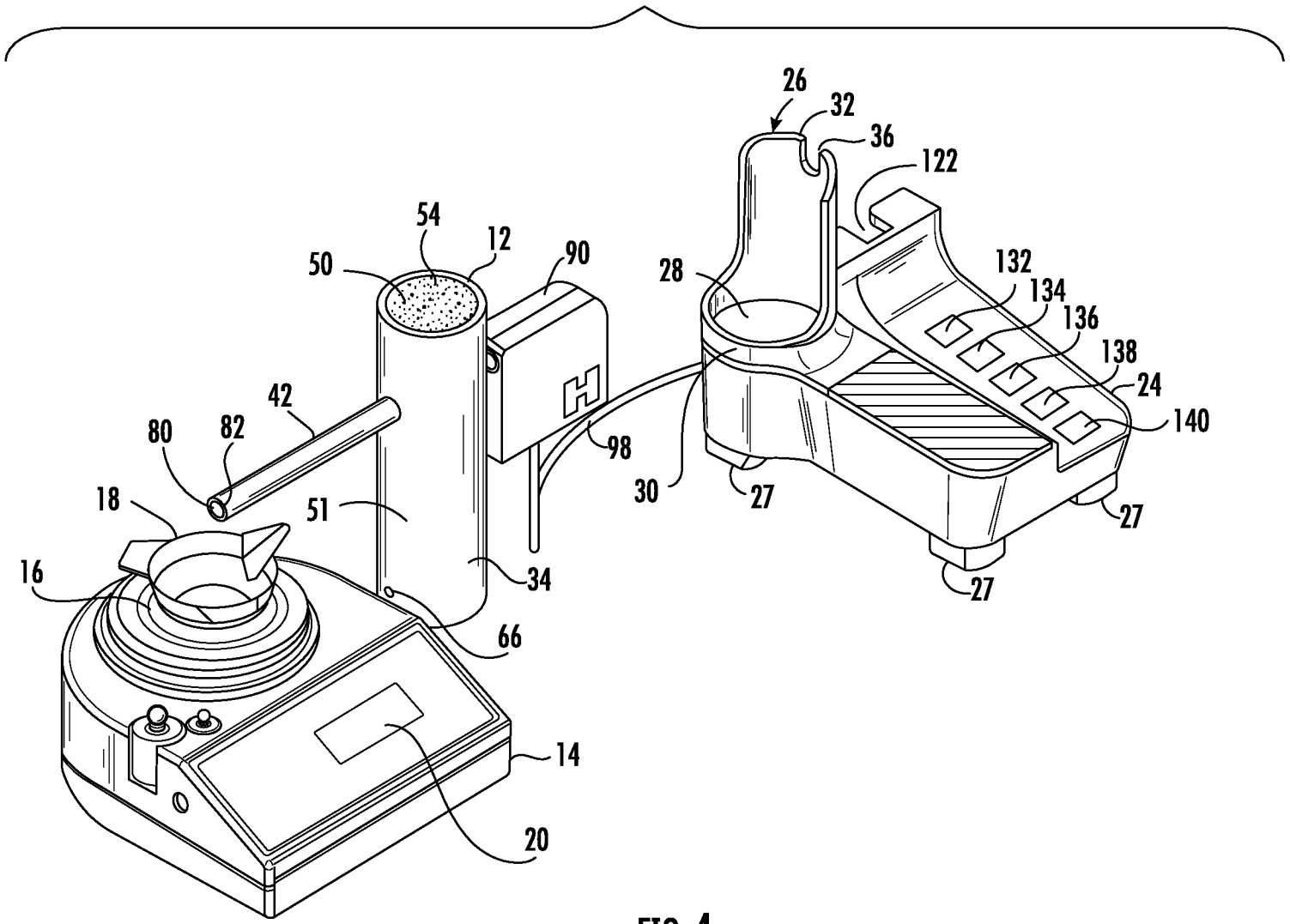
FIG. 4 is a perspective view of the powder trickier and scale as shown in FIG. 1 with the feed hopper separated from the controller base.

As seen in FIG. 2, the cord 98 can be stored in a storage chamber 120 and extend through a notch 122 between the chamber 120 and the housing 90 when the hopper 12 is to be used resting in the receptacle 28. The cord 98 can be uncoiled, allowing the hopper 12 to be removed from the base 24, for positioning remotely from the base 24, and rest on a counter or table top instead of in the receptacle 28, as seen in FIG. 4.

The trickier 11 is provided with means for controlling operation of the feeding of powder by controlling operation of the vibrator 110. As seen in FIG. 1, the base housing 24 is provided with a control panel 130 having a plurality of control elements 132, 134, 136, 138 and 140. Such control elements can be in the form of a pushbutton switch, proximity switch, and/or a touch sensitive switch device. The number of control elements will be determined by the degree of control desired. In the illustrated structure, the elements 132 and 140 provide for a variable speed adjustment of the rotational speed of motor 112. The element 132 provides an increase in speed of rotation, while the element 140 provides a decrease in speed of rotation. To operate in variable speed mode, either the element 132 and 140 is pressed until the appropriate speed setting is reached as indicated by the tachometer 141. Preferably, the change in speed is stepped in speed increments. Operation of the motor 112 and the tachometer 141 by use of the elements 132, 134, 136, 138 and 140 is controlled through an electronic controller 150 that is connected between the elements, the tachometer and the motor. The tachometer 141 can be a series of lights marked, e.g., 1-10, to indicate the set motor speed on an arbitrary scale. After setting the desired speed, the element 136 is pressed to start the motor 112 and held until a desired amount of powder is dispensed. Releasing the element 136 stops operation of the motor 112 and dispensing. The controller 150 can be suitably mounted anywhere in the housing 24. The subsequent activation of the element 136 starts operation of the motor 112 and feeding of the powder again at the set speed. The more times an element 132, 140 is contacted, the greater the change in motor speed. Preferably, the change in speed is in incremental steps. The operator, based on experience, would know when to stop motor rotation by watching the readout 20 on the scale 14. In addition, the control panel 130 can be provided with a control element 134 that would, during activation by the user by contacting the element 134, run the motor 112 at its preset top speed and, upon eliminating contact with the element 134, the motor 112 would stop rotating. Similarly, the operator can use the control element 138, like operation of the element 134, but would activate the motor 112 to run at its preset lowest operating speed.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A vibratory powder trickler including:

a base housing;

a hopper removably mounted to said housing and having an open top and a powder storage chamber;

a feed tube extending transversely through said hopper and mounted to a vibrator housing and having a powder flow passage therein and powder feed opening for powder flow communication between said passage and said storage chamber, said tube having a discharge opening positioned exteriorly of the hopper;

a vibrator assembly within said vibrator housing associated with said hopper and said feed tube and operable to selectively vibrate said hopper and said feed tube, said vibrator assembly including a motor; and control means coupled to the vibrator assembly and operable to control powered operation of the vibrator assembly, said control means including an electronic controller associated with a plurality of control elements usable by an operator of said trickler, at least one of said control elements being operable to set a motor rotational speed from a plurality of available speeds through the electronic controller.

2. The trickler of claim 1 including a weight positioned in a lower portion of said hopper.

3. The trickler of claim 1 wherein the vibrator assembly being mounted on said feed tube.

4. The trickler of claim 1 wherein said motor being an electric motor and said control elements including a motor speed increase first control element and a motor speed decrease second control element.

5. The trickler of claim 4 wherein said electronic controller being operable to change motor speed in steps.

6. The trickler of claim 4 wherein said control elements including a third control element operable to set the motor speed at a preset maximum speed.

7. The trickler of claim 6 wherein said control elements including a fourth control element operable to set the motor speed at a preset minimum speed.

8. The trickler of claim 7 wherein said control elements including a fifth control element operable to select variable speed for said motor and operable to allow use of said motor speed increase first control element and said motor speed decrease second control element to select motor speed.

9. The trickler of claim 8 wherein the control means includes a tachometer operable to indicate motor speed.

10. The trickler of claim 9 wherein said fifth control element being operable to start and stop operation of said motor after a motor speed is selected.

11. The trickier of claim 10 wherein said motor speed selection is through operation of at least one of said first and second control elements.

12. The trickler of claim 1 wherein said motor being operable to produce a vibration frequency of between about 50 hertz and about 225 hertz.

* * * * *